US007753655B2

(12) United States Patent
Saarinen et al.

(10) Patent No.: US 7,753,655 B2
(45) Date of Patent: Jul. 13, 2010

(54) MODULAR SYSTEM FOR THE CONTROL OF COMPRESSION SYSTEMS

(75) Inventors: Vesa Saarinen, Helsinki (FI); Lauri Valovirta, Espoo (FI); Sami Nyman, Kerava (FI)

(73) Assignee: CompAir UK Limited, Buckinghamshire (GB)

( * ) Notice: Subject to any disclaimer, the term of this patent is extended or adjusted under 35 U.S.C. 154(b) by 580 days.

(21) Appl. No.: 11/633,054

(22) Filed: Dec. 4, 2006

(65) Prior Publication Data

US 2007/0134114 A1 Jun. 14, 2007

Related U.S. Application Data

(63) Continuation of application No. 10/470,996, filed as application No. PCT/FI02/00082 on Feb. 4, 2002.

(30) Foreign Application Priority Data

Feb. 2, 2001 (FI) ..... 20010199

(51) Int. Cl.
*F04B 49/06* (2006.01)

(52) U.S. Cl. ..... 417/38; 417/2; 417/286; 417/426

(58) Field of Classification Search ..... 417/2, 417/38, 286, 426
See application file for complete search history.

(56) References Cited

U.S. PATENT DOCUMENTS 4,502,842 A 3/1985 Currier et al.
4,526,513 A 7/1985 Bogel
5,967,761 A 10/1999 Mehaffey
6,077,051 A * 6/2000 Centers et al. ..... 417/280
6,216,956 B1 4/2001 Ehlers et al.
6,244,824 B1 6/2001 Centers et al.
6,330,873 B1 12/2001 Letang et al.

* cited by examiner

*Primary Examiner*—Devon C Kramer
*Assistant Examiner*—Patrick Hamo
(74) *Attorney, Agent, or Firm*—Dykema Gossett PLLC

(57) ABSTRACT

A modular system for the control of at least one compression system for the compression a fluid medium, said compression system comprising compressors (C1-C7) and their controllers (A1-A7) for the compression of the fluid medium, secondary treatment devices for the treatment of the medium delivered from the compressors, and piping systems (17-19, 23) for conducting the fluid medium to a place of consumption (16, 22), said control system comprising a control unit (3) containing a data processing system (34) for controlling the compression system, a user interface (35) including a display associated with it and transmission means for the transmission of control data between the control unit, the controllers and pressure sensors. The transmission means consist of data communication buses, preferably serial communication buses (30-32) and a data communication port unit (33) serving to connect the bus to the control unit (34). The controllers and pressure sensors are connected to common data communication buses.

1 Claim, 1 Drawing Sheet

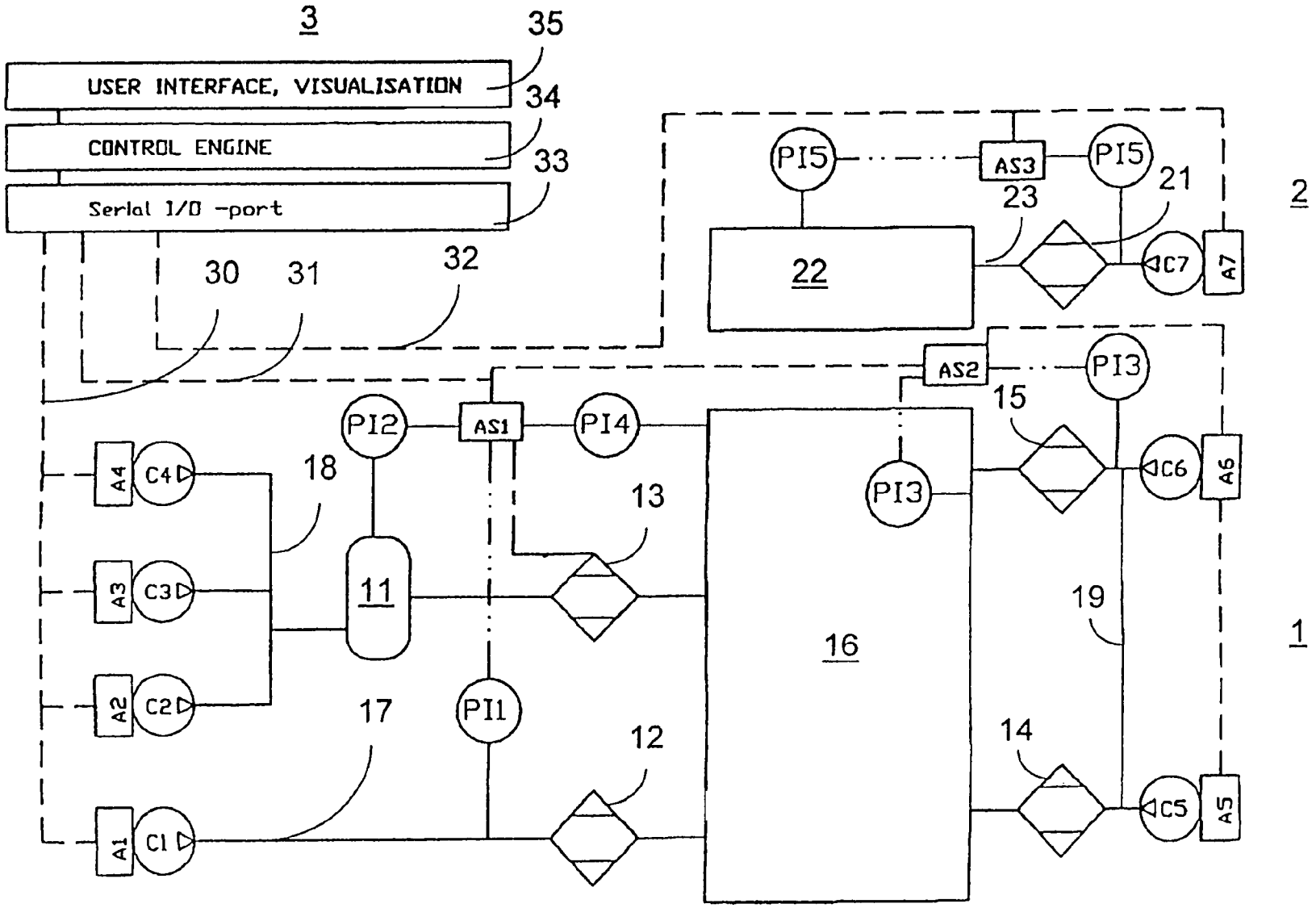
USER INTERFACE, VISUALISATION
CONTROL ENGINE
Serial I/O -port
3
35
34
33
32
31
30
2
1
A7
C7
PI5
21
AS3
23
22
A6
C6
PI3
19
15
AS2
16
A5
C5
14
PI4
13
12
AS1
PI1
PI2
11
17
18
A4
C4
A3
C3
A2
C2
A1
C1

MODULAR SYSTEM FOR THE CONTROL OF COMPRESSION SYSTEMS

CROSS-REFERENCE TO RELATED APPLICATIONS

This is a continuation of application Ser. No. 10/470,996, filed Oct. 14, 2003, which was a national phase filing of PCT/FI02/00082, filed 4 Feb. 2002, which was based on Finland Application No. 20010199, filed Feb. 2, 2001. All priorities are claimed.

BACKGROUND OF THE INVENTION

1. Field of the Invention

The present invention relates to a method for controlling a compression system for the compression of a fluid medium.

2. The Prior Art

In industrialized countries, about 10% of the electric energy consumed by industry is spent on the production of compressed air. In addition, compressed air is a critical production factor, and consequently quality problems appearing in compressed air are in many cases economically much more significant than the energy spent on producing it. Ineffective use of compressed air has been found to be a significant problem in many countries.

In the compression systems of compressed air networks, compressors are used to produce compressed air, which is conducted via a cooler and a pressure tank into a secondary treatment apparatus, which is provided with filters and driers, and into a second pressure tank, from where the compressed air is supplied to the place of consumption. The compressors are controlled by means of controllers connected via a data communication bus to a control computer controlling the system. Connected to the computer are additionally e.g. pressure sensors, and the data obtained from these is used in the control of the system.

WO specification 91/06762 discloses a compressor control apparatus of this type, which can be connected to a computer. Via a data communication bus, several compressors can be connected to the computer. An individual controller can control the mode of operation of an individual compressor, said modes being on/off-line, modulating operation and deloaded operation. In WO specification 91/06762, each controller of the compressor can be controlled individually by means of signal obtained from a computer. In addition, the apparatus comprises a graphic display, such as a LED display, on which it is possible to present e.g. controller parameters, and the operator of the apparatus can operate it via a user interface by pressing different switches.

To save energy in the production of compressed air, various methods have been developed. Among the most typical solutions are standard controllers provided by compressor manufacturers and having their own control programs, which can not be customized to suit other manufacturers' compressors and which comprise no verification of efficiency of control. In addition, partly modular methods have been developed that are customizable for several compressor types and permit the connection of several pressure sensors. There are also measuring methods that can be used to ascertain the benefit regarding energy economy achieved by the control. However, these measuring methods are of a single-operation nature, and they have to be repeated at regular intervals if the aim is to ensure a continuous high quality of performance. The prices of customizable solutions are high due to the large amount of programming work needed, among other things. Under these circumstances, the equipments have to be built in small production series, and consequently they are expensive.

A large proportion, even 80% of maintenance visits associated with control systems are attributable to a misuse failure. This is because present control systems are separate systems that, after their introduction, are not maintained except sporadically. When users are changed out for new ones, the training they have once received is no longer useful. This leads to a situation where, in the course of time, even a well performing system does not necessarily answer its purpose.

The object of the present invention is to achieve a new type of control system in order to enable the operation of pneumatic systems and equivalent to be rendered more effective on a large scale at a reasonable cost and with limited personnel resources. The details of the features characteristic of the system of the invention are presented in the claims below.

SUMMARY OF THE INVENTION

In the system of the invention, one or more compressors and the associated secondary treatment apparatus, connected to one or more compressed air networks or equivalent, are controlled and monitored. The system of the invention is based on a modular technique as far developed as possible, utilization of parameters and inter-modular fault diagnostics. By additionally combining these features with a possibility of remote monitoring and programmability, a maximally reliable solution of favorable cost is guaranteed. In addition, the system contains useful analyzing and reporting features that make it possible to verify the benefit provided by the system and to maintain a good performance of the network and to improve it on a continuous basis.

Due to its architecture, the system can be constructed from standard components produced by automation manufacturers. The invention allows a decisive reduction to be achieved in the amount of work required at installation time.

BRIEF DESCRIPTION OF THE DRAWING

In the following, the invention will be described in detail with reference to the attached drawing, which presents a block diagram of a pneumatic system comprising a control unit 3 according to the invention.

DETAILED DESCRIPTION OF THE PREFERRED EMBODIMENT

The pneumatic system comprises two compressed air networks 1, 2, which are connected to a control system that controls them. The first network 1 comprises six compressors C1-C6 with their controllers A1-A6, a pressure tank 11 connected to three compressors C2-C4, four secondary treatment units 12-15, a place of consumption 16 and piping systems 17-19 for their interconnection. The second network 2 correspondingly comprises one compressor C7 with its controller A7, a secondary treatment unit 21, a place of consumption 22 and a piping system 23 for their interconnection.

In addition, both networks are provided with pressure sensors PI1-PI5, of which PI1 is connected to the pressure tank piping 17 between compressor C1 and secondary treatment unit 12, PI2 to the pressure tank, 11, PI3 to the piping 19 between compressors C5, C6 and secondary treatment unit 14, 15, PI3 and PI4 to the place of consumption 16 and PI5 to the piping 23 between compressor C7 and secondary treatment unit 21 as well as to the place of consumption 22, and of pneumatic station controllers AS1-AS3, of which AS1 is connected to sensors PI2, PI4, PI1 and to secondary treatment unit 13, AS2 is connected to controllers A5, A6 and sensor PI3, while AS3 is connected to sensors PI5.

The above-described controllers and sensors are connected via three serial communication buses 30-32 common to both devices to a serial port 33 of the control unit 3 and further to the control computer 34, which comprises a display and a user interface 35. The user interface is provided with a user interface program, and the control computer is provided with a group control program and a controller unit.

Via the user interface 35, the user can observe the operation of the pneumatic system, configure the control and monitoring system and output reports concerning the functioning of the system. The control program regulates and controls the pneumatic system via the pneumatic station controllers and compressor controllers, based on the information obtained by means of the data communication devices and programs and on the instructions given by the user.

The pneumatic station controller AS1-AS3 reads pneumatic station-specific data, such as pressure and alarm data from the pneumatic system. The compressor controller A1-A7 reads data regarding the compressor and the control commands sent by the control program via the data communication bus 30-32 and executes the commands, such as start, stop and load.

The number of compressors can be given as parameters to the group control program. The control program need not be altered in any way when compressors are added or removed. This is because, as far as the compressors are concerned, the program has been constructed according to a modular design such that each compressor C1-C7 is an embodiment of its category that, depending on the parameter given, is either commissioned or decommissioned.

Each compressor C1-C7 can be configured via the user interface 35 as any compressor type by means of one parameter given. Therefore, when the control system is being configured for the first time or when an individual compressor type is later changed, the control system need not be tailored at all. This is due to the fact that, by means of a single parameter, the above-described embodiments of compressor category can be configured as any basic compressor type. These are two-stage, three-stage and five-stage modulating control and kinetic machine control.

It is possible to connect to the control system a required number of pressure sensors PI1-PI5 to read the delivery pressure of each compressor and the desired network pressures. This makes easier to control the compressors and gives a general view of the state of the pneumatic network. Any one of the pressure sensors can be configured to indicate the delivery pressure of any one of the compressors, and any of the pressure sensors can be configured to function as the control pressure of the entire system. The number of pressure sensors can be configured with one value, which is input via the user interface 35. The addition or removal of pressure sensors does not involve any changes in the control program.

Each pressure data item also contains information as to how large a volume it pertains to and what is the rate of change of the pressure. Based on these data, it is possible to calculate the exact change in the amount of compressed air for the volume in question. By computing the change in the amount of air for each volume and combining this information with the data regarding the state of all the compressors, real-time actual consumption of compressed air is obtained. This method considerably improves the accuracy and reacting capability of the control.

The control system can control and monitor several separate pneumatic systems 1, 2. This makes it possible to select any one of the pressure sensors PI1-PI5 connected to the system as a control pressure sensor for each compressor C1-C7, and in addition any one of the compressors can be set via the user interface to be controlled according to a pressure sensor value selected in accordance with separate pressure settings.

For each compressor C1-C7 and for the pneumatic system, maximum and minimum pressure limits can be set. When these values are exceeded, control of the compressors is handed over to their own control system.

The order in which the compressors C1-C7 are started and loaded is determined by an operating sequence table. The compressors can be set to work in accordance with as many operating sequence tables as desired. This is possible because each individual operating sequence is an embodiment of its category that can be commissioned or decommissioned by changing a program parameter determining the number of embodiments. Therefore, the program need not be altered at all when operating sequences are added or removed.

The manner of changing the operating sequence is selected by changing one control parameter. The operating sequence can be changed e.g. on the basis of a weekly calendar, stoppage of compressors or an automatic arrangement.

Automatic alternation is based on continuous computation of the required idling power for all compressor combinations possible, which, combined with the observation of the required compressors C1-C7 to be kept active and free selection of the observation interval, results in automatic selection of the most effective operating sequence possible.

The method of starting and stopping a compressor C1-C7 can be selected via the user interface. These are pulse starting and stopping and pulse duration, continuous starting and stopping, run-on stopping or stopping based on allowed numbers of starts.

The starting, loading and deloading delays for each compressor C1-C7 can be adjusted separately. This allows correct operation of the method in every situation regardless of the pneumatic system's own dynamics.

The information regarding compressor states and pressure values received by the control program via the data communication means 30-32 is continuously stored on a mass storage medium (in the control computer 34). The state of operation and pressure level of the compressors can be presented in the same diagram so that they can be viewed in a graphic form from instant to instant. This enables the pneumatic system to analyzed in real time or afterwards.

The control program calculates the total output and power input of the pneumatic system on a continuous basis. These data are stored on a mass storage medium. In the user interface, these data can be presented in the same diagram so that they can be viewed in a graphic form from instant to instant. In addition, the user interface calculates the average consumption and power over a selected period of time. Moreover, the points of the diagram can be printed to a file with a desired time interval. The report thus produced allows verification of the actual benefit yielded by the control system and continuous measurement of performance even over a long period.

The compressor controller A1-A7 reads information from the compressor and transmits it to the control program, reads the control commands from the group control program and executes them in accordance with its own control program while also monitoring the validity of the commands and the condition of the data communication bus and the programs. The compressor program is a compressor type and model-specific program. As an example, consider a pressure-switch-controlled model that is stopped and started by a run-on timer.

About 50% of all compressors are of this type. About 5 different compressor controller models cover about 95% of the entire compressor capacity. In current solutions, even a single non-standard compressor model to be incorporated under the control system requires relatively extensive tailoring of the control programs. This problem is now limited to the tailoring of a simple compressor controller program. Even this tailoring work will be reduced when this solution gains ground, because it will be easy to form a library of compressor controller programs.

The basic architecture of the method allows the use of a device of any manufacturer in the compressor controller. This makes it possible to utilize the invention in many cases in which it has not been possible before.

When a disturbance, e.g. a connection fault, occurs in any part of the system, the compressor controller hands over the control to the compressor's own control system. This guarantees disturbance-free production of compressed air in almost all situations.

The operation of the compressor controller can be tested either by means of a group controller or any device that is capable of writing the run and load commands to the controller. This is made possible by the structure of the controller program, in which the outward interface can be kept as simple and standard as possible regardless of compressor type and model. Only the run/stop commands and the desired load factor are written via the interface.

It is obvious to the person skilled in the art that different embodiments of the invention are not limited to the examples described above, but that they may be varied within the scope of the following claims.

The invention claimed is:

1. A method for the control of a compression system for compressing a fluid medium, said compression system comprising a plurality of compressors (C1-C7) for the compression of the fluid medium, a plurality of controllers (A1-A7) respectively associated with said plurality of compressors, secondary treatment devices for treatment of the fluid medium delivered from the plurality of compressors, a plurality of piping systems (17-19, 23) for conducting the fluid medium from the compressors to a place of consumption (16, 22), and a plurality of pressure sensors (P11-P15) for reading fluid medium pressure delivered from the plurality of compressors to the control unit;

a control unit (3) containing a data processing system (34) for controlling the compression system, and a user interface (35) including a display; and transmission means for transmission of control data between the control unit, the plurality of controllers and the pressure sensors, the transmission means consisting of at least one data communication bus and a data communication port unit (33) serving to connect the bus to the control unit (3); said method comprising the steps of connecting the plurality of controllers and the plurality of pressure sensors to a common data communication bus, selecting one of the pressure sensors (P11-P15) which provides a pressure sensor value and selecting a pressure setting of at least one of the compressors via the user interface according to said pressure sensor value, configuring each compressor (C1-C7) via the user interface (35) as to compressor type by means of a first user-chosen parameter, configuring the number of pressure sensors by means of a second user-chosen parameter via the user interface (35), each item of pressure data from the pressure sensors containing volume and rate of pressure change data, and connecting the plurality of pressure sensors to a bus (30-32) via associated pneumatic station controllers (AS1-AS3), which read pneumatic station-specific pressure and alarm data from the plurality of piping systems.

* * * * *

UNITED STATES PATENT AND TRADEMARK OFFICE

CERTIFICATE OF CORRECTION

PATENT NO. : 7,753,655 B2
APPLICATION NO. : 11/633054
DATED : July 13, 2010
INVENTOR(S) : Vesa Saarinen It is certified that error appears in the above-identified patent and that said Letters Patent is hereby corrected as shown below:

Title page, item [73] should read as follows:

[73] Assignee: Sarlin Oy AB, Helsinki, Finland

Signed and Sealed this
Fourth Day of March, 2014

Michelle K. Lee

Michelle K. Lee
*Deputy Director of the United States Patent and Trademark Office*